US011293068B2

(12) United States Patent
Hatakeyama et al.

(10) Patent No.: US 11,293,068 B2
(45) Date of Patent: Apr. 5, 2022

(54) REDUCED IRON PRODUCTION METHOD

(71) Applicant: Kobe Steel, Ltd., Kobe (JP)

(72) Inventors: Taiji Hatakeyama, Kobe (JP); Shorin O, Kobe (JP); Masahiro Hotta, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 556 days.

(21) Appl. No.: 16/301,272

(22) PCT Filed: May 12, 2017

(86) PCT No.: PCT/JP2017/017977
§ 371 (c)(1),
(2) Date: Nov. 13, 2018

(87) PCT Pub. No.: WO2017/199868
PCT Pub. Date: Nov. 23, 2017

(65) Prior Publication Data

US 2020/0291494 A1 Sep. 17, 2020

(30) Foreign Application Priority Data

May 20, 2016 (JP) ..... JP2016-101617

(51) Int. Cl.
*C21B 13/00* (2006.01)
*C21B 13/10* (2006.01)

(52) U.S. Cl.
CPC ..... *C21B 13/105* (2013.01); *C21B 13/004* (2013.01)

(58) Field of Classification Search
CPC ..... C21B 13/004; C21B 13/105
USPC ..... 75/484
See application file for complete search history.

(56) References Cited

U.S. PATENT DOCUMENTS 1,833,322 A * 11/1931 Davis ..... F27B 3/00 432/161
8,915,352 B2 * 12/2014 Tsuge ..... C21B 13/0053 198/752.1
10,571,193 B2 * 2/2020 Hatakeyama ..... F27B 9/20
2013/0153368 A1 6/2013 Tsuge et al.
2014/0251084 A1 * 9/2014 Chevrier ..... C22B 34/32 75/10.18
2015/0361515 A1 * 12/2015 Kikuchi ..... C21B 13/008 75/484

OTHER PUBLICATIONS

International Search Report dated Aug. 1, 2017 in PCT/JP2017/017977 filed May 12, 2017.

* cited by examiner

*Primary Examiner* — Jie Yang
(74) *Attorney, Agent, or Firm* — Oblon, McClelland, Maier & Neustadt, L.L.P.

(57) ABSTRACT

Disclosed herein is a reduced iron production method enabling heat to be input well into reduced-iron raw materials on a hearth covering material in a reduction-melting furnace to improve the efficiency of treatment thereof. The reduced-iron raw materials are set on the hearth covering material through their falls and reduced on the hearth covering material. The hearth covering material is constituted by carbon materials each having a particle diameter of 5 mm or less. At least 7 mass % of the carbon materials have respective particle diameters each being 0.1 mm or less. This restrains the reduced-iron raw materials from embedment into the hearth covering material.

5 Claims, 12 Drawing Sheets

REDUCED IRON PRODUCTION METHOD

TECHNICAL FIELD

The present invention relates to a method for producing reduced iron by charging a plurality of reduced-iron raw materials containing a carbonaceous reducing agent and iron oxide into a traveling-hearth reduction melting furnace to treat the raw materials.

BACKGROUND ART

There has been conventionally known a method for producing reduced iron, the method including charging a plurality of reduced-iron raw materials, each of which contains a carbonaceous reducing agent and an iron oxide, into a traveling-hearth reduction melting furnace to treat them. For example, Patent Literature 1 discloses a method including preparing numerous spherical pellets as the plurality of reduced-iron raw materials, inserting these pellets successively into the traveling-hearth reduction melting furnace to heat the pellets, and separating the reduced iron (metal iron) produced by the heating from a slag to discharge the reduced iron to outside of the reduction-melting furnace.

The traveling-hearth reduction melting furnace has a hearth capable of traveling in a specific direction and a ceiling located over the hearth, each of which is formed of a refractory such as a brick. On the hearth is provided a hearth covering material to protect the refractory. On the hearth, there are continuously carried out a series of treatments on the iron oxide: namely, reduction, cementation, melting, aggregation, and slag separation. In order to inhibit the iron oxide to be thus treated and the refractory forming the hearth from direct contact with each other, the hearth covering material is laid with a suitable layer thickness onto the hearth.

As means for charging each of the pellets into the reduction-melting furnace, Patent Literature 1 in FIG. 8 discloses successively letting each of the pellets fall freely from the ceiling onto the hearth, specifically onto the hearth covering material, through a plurality of supplying units provided in the ceiling.

In producing reduced iron from the plurality of reduced-iron raw materials in a traveling-hearth reduction melting furnace such as described above, it is desirable to treat the reduced-iron raw materials efficiently in a period of time as short as possible. As effective means therefor, the present inventors have focused on securing a contact area between each of the reduced-iron raw materials and a high-heat gas in the surroundings thereof and a heat-receiving area included in the surface area of the reduced-iron raw materials, the heat-receiving area being the area in which the reduced-iron raw materials receive the heat given by radiation, to thereby promote good heat input, and have found out, from such a viewpoint, that the conventional technique disclosed in Patent Documents 1 raises an important problem.

Specifically, the reduced-iron raw materials successively charged into the melting furnace through their free falls as disclosed in Patent Document 1 include not a few ones at least a part of which is embedded in the powdery hearth covering material; this embedment of each of the reduced-iron raw materials may reduce the contact area between the reduced-iron raw materials and the high-temperature gas in the furnace and the heat-receiving area included in the surface area of the reduced-iron raw materials, the heat-receiving area being the area in which the reduced-iron raw materials receives the heat given by radiation, thereby hindering heat from being input well into the reduced-iron raw materials.

CITATION LIST

Patent Literature

Patent Literature 1: Japanese Unexamined Patent Publication No. 2012-052741

SUMMARY OF INVENTION

An object of the present invention is to provide a method for producing reduced iron by charging a plurality of reduced-iron raw materials each containing a carbonaceous reducing agent and iron oxide into a traveling-hearth reduction melting furnace and treating the reduced-iron raw materials, the method enabling heat to be input well into each of the reduced-iron raw materials supplied through their respective falls onto a powdery hearth covering material to thereby enhance the efficiency of treatment thereof.

Provided is a method for producing reduced iron, the method including: a raw material charging step of successively charging a plurality of reduced-iron raw materials each containing a carbonaceous reducing agent and an iron oxide into a reduction-melting furnace having a hearth that travels in a specific direction and a hearth covering material formed of powder laid on the hearth and letting the reduced-iron raw materials fall onto the hearth covering material to set the reduced-iron raw materials on the hearth covering material; and a reduced iron discharging step of successively reducing each of the reduced-iron raw materials on the hearth covering material along with travel of the hearth to thereby produce reduced iron and discharging the reduced iron produced to outside of the reduction-melting furnace. The hearth covering material is constituted by carbon materials each having a particle diameter of 5 mm or less. At least 7 mass % of the carbon materials have respective particle diameters each being 0.1 mm or less.

DESCRIPTION OF EMBODIMENTS

There will be described preferable embodiments of the present invention with reference to the drawings.

Figure 1:
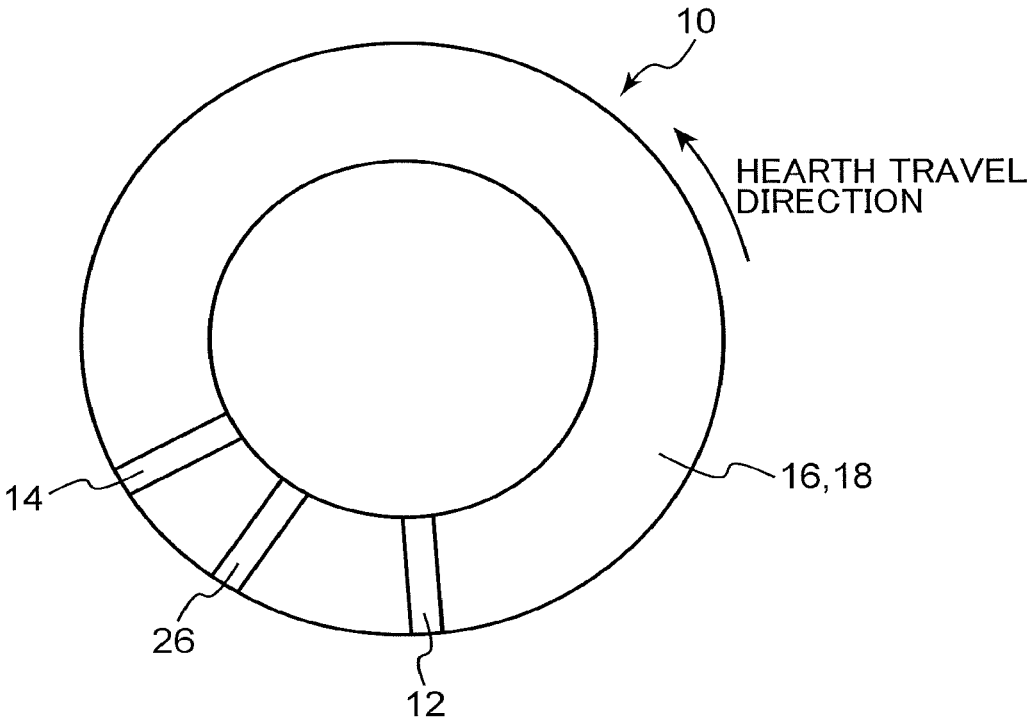
FIG. 1 is a plan view of a reduced iron production apparatus used for conducting a reduced iron production method according to a first embodiment of the present invention.
Figure 2:
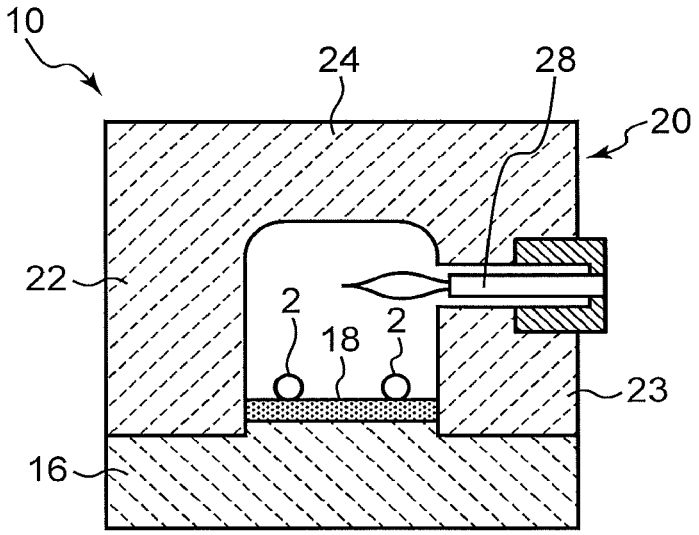
FIG. 2 is a view showing a section taken along a radial direction of a traveling-hearth reduction melting furnace in the reduced iron production apparatus.
Figure 3:
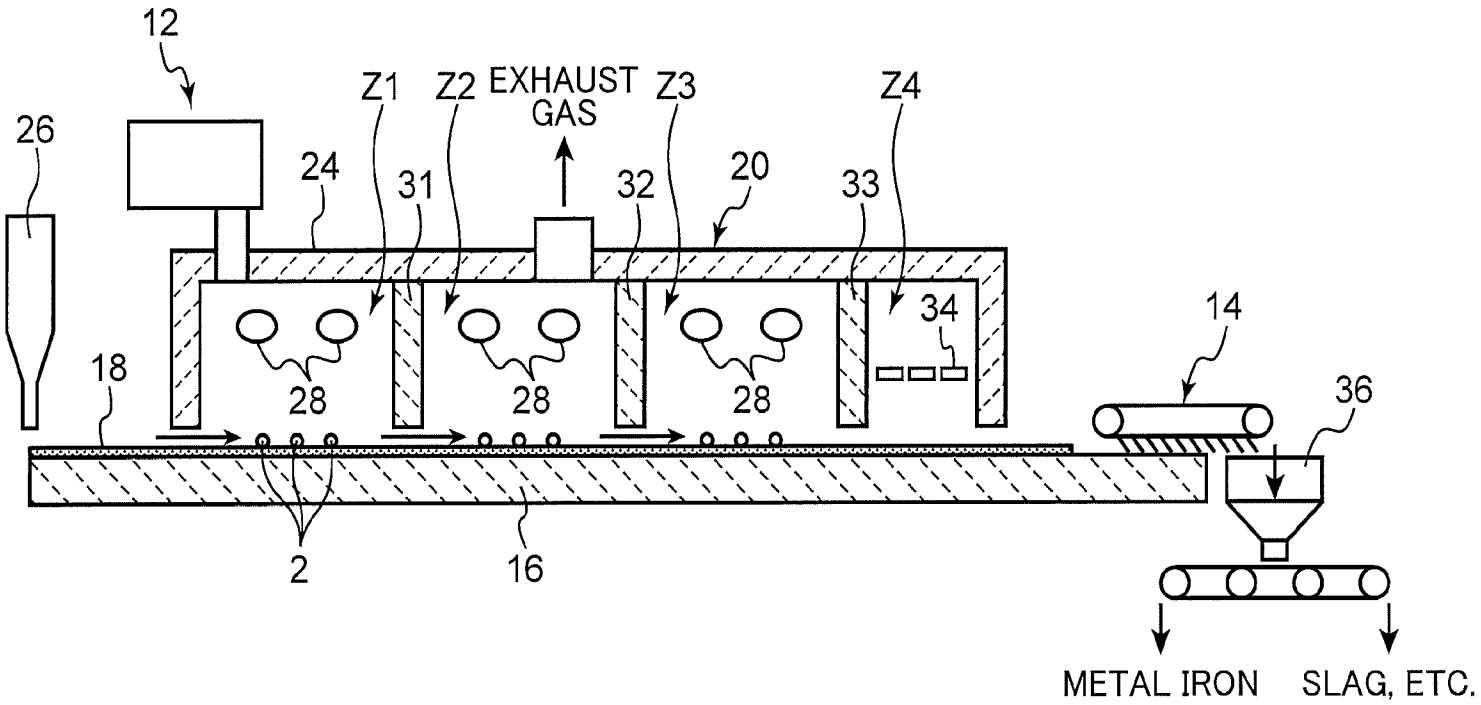
FIG. 3 is a sectional view showing the reduction-melting furnace as expanded along the travel direction of a hearth thereof.

FIGS. 1 to 3 show a reduced iron production apparatus according to a first embodiment of the present invention. This reduced iron production apparatus is used for producing reduced iron by successively heating numerous reduced-iron raw materials 2, each of which contains a carbonaceous reducing agent and an iron oxide. Each of the reduced-iron raw materials 2 only has to be individually separated independent agglomerate, and the shape of the reduced-iron raw material 2 is not particularly limited. The reduced-iron raw material 2 shown in FIGS. 2 to 3 is, for example, spherical, but is not be required to be a complete sphere. Each of the reduced-iron raw materials 2 is preferably dried in advance.

The reduced iron production apparatus includes a traveling-hearth reduction melting furnace 10, a plurality of raw material charging units 12, and a discharging unit 14. The reduction-melting furnace 10 treats the reduced-iron raw materials 2 charged to the inside thereof to thereby produce reduced iron (metal iron). Specifically, in the reduction-melting furnace 10, there are carried out the following treatments of the iron oxide: temperature-raising, reduction, melting, aggregation, slag separation, cooling and the like. The plurality of raw material charging units 12 charge the reduced-iron raw materials 2 successively into the reduction-melting furnace 10 from a plurality of positions different from each other. The discharging unit 14 discharges reduced iron and slag that have been produced in the reduction-melting furnace 10, to outside of the reduction-melting furnace 10.

The reduction-melting furnace 10 includes a hearth 16, a hearth covering material 18, a furnace body 20, and a not-graphically-shown hearth driving device. The hearth 16 and the furnace body 20 is formed of, for example, a refractory containing alumina as a major component.

The hearth 16 has an annular-ring shape that internally encloses a circular space with a width constant along the radial direction thereof. The hearth driving device drives the hearth 16 so as to bring the hearth 16 into rotational movement at a predetermined speed in a predetermined direction (anticlockwise direction in FIG. 1) around a vertical axis which is a central axis of the hearth 16. The hearth 16 according to the first embodiment is, thus, able to travel at a predetermined speed along the rotational circumferential direction thereof.

The hearth covering material 18 is laid on the hearth 16 in order to protect the hearth 16, specifically to inhibit the hearth 16 from direct contact with the reduced-iron raw materials 2. The hearth covering material 18 is formed of numerous particles of powder.

Onto the hearth covering material 18, the reduced-iron raw materials 2 are set in such a manner as to pass through the furnace body 20 (specifically, through a below-described ceiling 24) from the plurality of raw material charging units 12 and to fall onto the hearth covering material 18.

The hearth covering material 18 restrains the reduced-iron raw materials 2 that fall from each of the plurality of raw material charging units 12 from being embedded into the hearth covering material 18. For this restraint, there is used, as the hearth covering material 18, one having a particle size smaller than that of a conventional hearth covering material. Specifically, the hearth covering material 18 is constituted by carbon materials each having a particle diameter of 5 mm or less. At least 7 mass % of the carbon materials have respective particle diameters each being 0.1 mm or less. The use of the hearth covering material formed of such fine-particle carbon materials makes it possible to effectively restrain the reduced-iron raw materials 2 from embedment into the hearth covering material 18.

The reason why it is preferable that each of the carbon materials forming the hearth covering material 18 has a particle diameter of 5 mm or less is that the slag generated together with the iron oxide in the reduction-melting furnace 10 has an average particle diameter greater than 5 mm, which allows the carbon materials each having a particle diameter of 5 mm or less (for example, a particle diameter of about 3.5 mm) to be separated from the slag.

The carbon materials used as the hearth covering material 18 only has to be carbon materials that are capable of preventing the slag from infiltration into the refractory forming the hearth 16 and are renewable; for example, carbon materials such as anthracite or coke are desirable. Besides, also can be used as the hearth covering material 18 a carbon material such as coke, which is recycled by separating the hearth covering material turned into coke collected together with reduced iron and slag, from the reduced iron and the slag with use of a sieve or the like.

Removing, from the carbon materials, ones each having a particle diameter greater than 5 mm by separation means such as a sieve and controlling the particle diameter distribution of the carbon materials through addition of fine-particle carbon materials or the like so that at least 7 mass % of the carbon materials have respective particle diameters each being 0.1 mm or less enables a fine-particle hearth covering material to be produced, wherein the covering material is constituted by carbon materials each having a particle diameter of 5 mm or less and at least 7 mass % of the carbon materials have respective particle diameters each being 0.1 mm or less, as described above.

The furnace body 20 integrally has an inside wall 22, an outside wall 23, and a ceiling 24. The inside wall 22 and the outside wall 23 stand up from an inside edge and an outside edge of the hearth 16, respectively. The hearth 16 is connected with both of the side walls 22, 23 so as to be able to make relative displacement to the side walls 22, 23 in the rotational direction of the hearth 16 (hearth travel direction). The ceiling 24 is located over the hearth 16 across respective upper ends of the two side walls 22, 23, having a constant thickness. The vertical dimension from the upper surface of the hearth 16 (exactly the upper surface of the hearth covering material 18) to a lower surface 24*a* of the ceiling 24, namely, a ceiling height, is determined so as to prevent scattering of the hearth covering material 18 due to increase in the flow rate of the in-furnace gas and clogging due to adherence of substances and the like. The ceiling height is preferably at least 100 mm or more, typically 200 mm or more.

This reduced iron production apparatus further includes a hearth covering material resupplying device 26 shown in FIGS. 1 and 3. The hearth covering material resupplying device 26 resupplies a new hearth covering material 18, in an amount corresponding to the amount of the hearth covering material 18 that is discharged together with the metal iron and the slag in the discharging unit 14, onto the hearth 16 at appropriate times.

This reduction-melting furnace 10 further includes a plurality of burners 28. The burners 28 are disposed at a plurality of positions aligned along the travel direction of the hearth 16, respectively, to perform combustion of fuels at the respective positions. The heat generated by the combustion is transmitted through radiation or the like to each of the reduced-iron raw materials 2 that are successively charged into the furnace, contributing to reduction and melting of the reduced-iron raw materials 2.

As shown in FIG. 3, the reduction-melting furnace 10 includes a plurality of partition walls 31, 32, 33, which partition the inside space of the reduction-melting furnace 10 into a plurality of zones aligned along the travel direction of the hearth 16. The plurality of zones include a temperature-raising zone Z1, a reduction zone Z2, a melting zone Z3, and a cooling zone Z4. In the temperature-raising zone Z1, the temperature of the charged reduced-iron raw materials 2 is raised. In the reduction zone Z2, the reduced-iron raw materials 2 are reduced. In the melting zone Z3, the reduced-iron raw materials 2 are further heated to be melted, which allows the reduced iron to be separated from the slag and to be aggregated into granular melted metal iron. This melted metal iron is cooled by a cooling device 34 provided in the cooling zone Z4, thus being solidified. Each of the treatments on the reduced-iron raw materials 2 in the respective zones Z1 to Z4 is carried out on the hearth covering material 18.

The discharging unit 14 is disposed downstream of the cooling zone Z4. The discharging unit 14 includes, for example, a screw conveyor and discharges the metal iron solidified in the cooling zone Z4 as well as the slag and the like to outside of the reduction-melting furnace 10. The discharged metal iron as well as slag and the like are put into a discharge hopper 36 and are separated from each other by a not-graphically-shown separation device. Through the series of above-described steps, produced is granular metal iron having an extremely small content of slag components.

Next will be described details of the plurality of raw material charging units 12 with reference to FIGS. 4 to 5.

Figure 4:
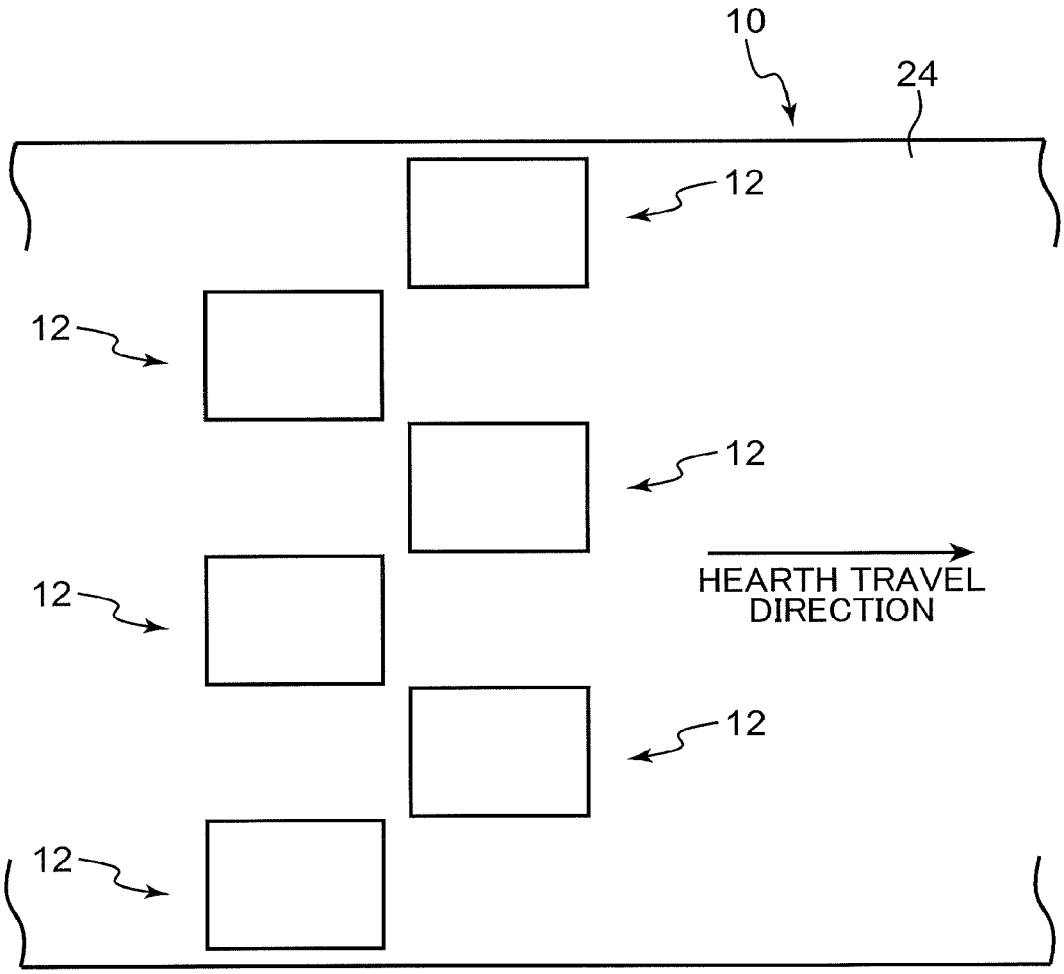
FIG. 4 is a plan view showing an arrangement of a plurality of raw material charging units included in the reduced iron production apparatus.

As shown in FIG. 4, the plurality of raw material charging units 12 according to the first embodiment are disposed at a plurality of positions arranged in zigzag form in the ceiling 24 of the reduction-melting furnace 10, respectively, and configured to charge the reduced-iron raw materials 2 at the respective positions. The present invention is, however, not limited with respect to the specific number and arrangement of the raw material charging units in the reduced iron production apparatus. For example, it is also possible that all the reduced-iron raw materials are inserted into the reduction-melting furnace through a single raw material charging unit.

Each of the raw material charging units 12 includes an introduction tube 45 penetrating the ceiling 24 and a raw material supplying unit 44.

The introduction tube 45 extends vertically, being inserted into a through-hole 47 formed in the ceiling 24.

The raw material supplying unit 44 supplies the reduced-iron raw materials 2 onto the hearth covering material 18 through letting the reduced-iron raw materials 2 fall successively through the introduction tube 45. The raw material supplying unit 44 according to the first embodiment includes a supply hopper 50 that receives the reduced-iron raw materials 2 provided in a large number, a feeder tray 52 that receives the reduced-iron raw materials 2 supplied from this supply hopper 50 and is connected to the introduction tube 45, and a vibration applying device 54 that imparts vibration to this feeder tray 52 to let the reduced-iron raw materials 2 fall successively from the feeder tray 52 into the introduction tube 45.

A structure for interconnecting the introduction tube 45 and the feeder tray 52 is not limited. The two may be interconnected through a connection member such as a flange; a water seal may be interposed between the two. Besides, it is also possible to omit the introduction tube 45 and to connect the raw material supplying unit directly to the ceiling 24.

Next will be described a reduced iron production method according to the first embodiment of the present invention using the reduced iron production apparatus shown in FIGS. 1 to 5.

First, there are prepared numerous reduced-iron raw materials 2, that is, a plurality of agglomerates each containing a carbonaceous reducing agent and an iron oxide. Each of the agglomerates is, for example, spherical; however, the shape is not limited to a spherical shape. The diameter of each of the reduced-iron raw materials 2 can be appropriately set, thus not being limited. Typically, the preferable diameter is 19 mm or more and 27 mm or less. Since reduced iron raw materials 2 with a particle diameter of 19 mm or more has a large size relatively to the particles of the carbon materials constituting the scattering hearth covering material 18, the degree of embedment of the reduced-iron raw materials 2 into the hearth covering material 18 is small. Besides, the particle diameter of 27 mm or less restrains the extension of the time that is required in reduction, melting, aggregation, and slag separation from being superior to the rate of increase in the reduced iron weight per unit area on the hearth, which can suppress decrease in the productivity due to that.

The thus prepared numerous reduced-iron raw materials 2 are successively charged into the reduction-melting furnace 10 through their respective falls onto the hearth covering material 18 and set on the hearth covering material 18 (raw material charging step). Specifically, the numerous reduced-iron raw materials 2 are put into the supply hopper 50 of the raw material supplying unit 44 in each raw material charging unit 12 and successively supplied into the introduction tube 45 penetrating the ceiling 24, through the feeder tray 52, making substantially vertical free fall onto the hearth covering material 18 through the introduction tube 45 to land.

Figure 6:
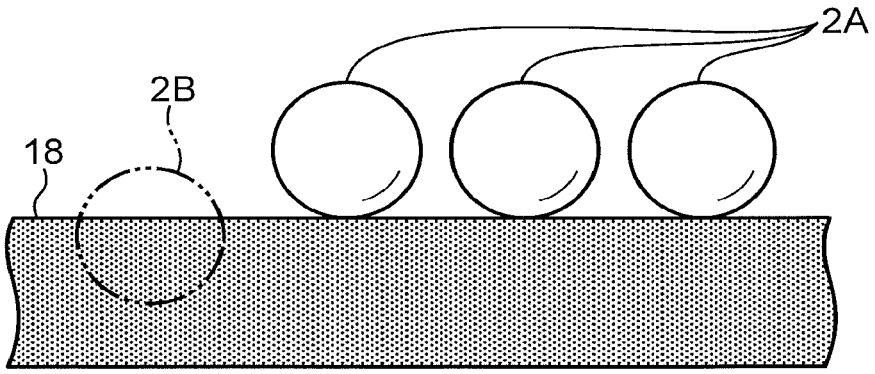
FIG. 6 is a sectional view showing an example of a state of the reduced-iron raw material having been charged into the reduction-melting furnace of FIG. 5.

As described above, the hearth covering material 18 used in the reduced iron production method of the first embodiment is formed of finer particles than carbon materials that constitute a conventional hearth covering material (specifically, rough-particle carbon materials containing only less than 7 mass % of carbon materials having respective particle diameters each being 0.1 mm or less, or the like). Specifically, the hearth covering material 18 is constituted by carbon materials each having a particle diameter of 5 mm or less, and at least 7 mass % of the carbon materials have respective particle diameters each being 0.1 mm or less. This makes it possible to effectively restrain the reduced-iron raw materials 2 from embedment into the hearth covering material 18. Thus, as shown in FIG. 6, a large number of reduced-iron raw materials 2A of the reduced-iron raw materials 2 can be disposed on the hearth covering material 18, thereby being allowed to receive heat through almost the entire surface of the raw material 2A. Besides, the number of reduced-iron raw materials 2B that are embedded into the hearth covering material 18 is greatly reduced.

The numerous reduced-iron raw materials 2 charged into the reduction-melting furnace 10 are successively reduced on the hearth covering material 18 along with movement of the hearth 16. Reduced iron is thereby produced and discharged to the outside of the reduction-melting furnace 10 (reduced iron discharging step).

As described above, charging of the reduced-iron raw materials 2 with effective suppression of the embedment of the reduced-iron raw materials 2 allows heat to be input well into the reduced-iron raw materials 2. This heat input enables the reduced-iron raw materials 2 to be subject to good heating treatments (temperature-raising, reduction, and melting treatments) in the respective zones Z1 to Z3 within a short period of time. The reduced iron thereafter cooled in the cooling zone Z4 can be discharged, by the discharging unit 14, as high quality metal iron.

Specifically, measurement were made on the reaction time of reduced-iron raw materials (period of time from the time at which the reduced-iron raw materials are put into the furnace and start being heated until the time at which the separation of the reduced iron from the slag is completely finished), which allows it to be confirmed that the treatments of reduced-iron raw materials half of which are embedded in the hearth covering material 18 require a reaction time that is about 1.35 times as long as that of the treatments of reduced-iron raw materials which are not embedded in the hearth covering material 18 at all. Accordingly, prevention of the embedment enables the reaction time to be considerably shortened.

Figure 7:
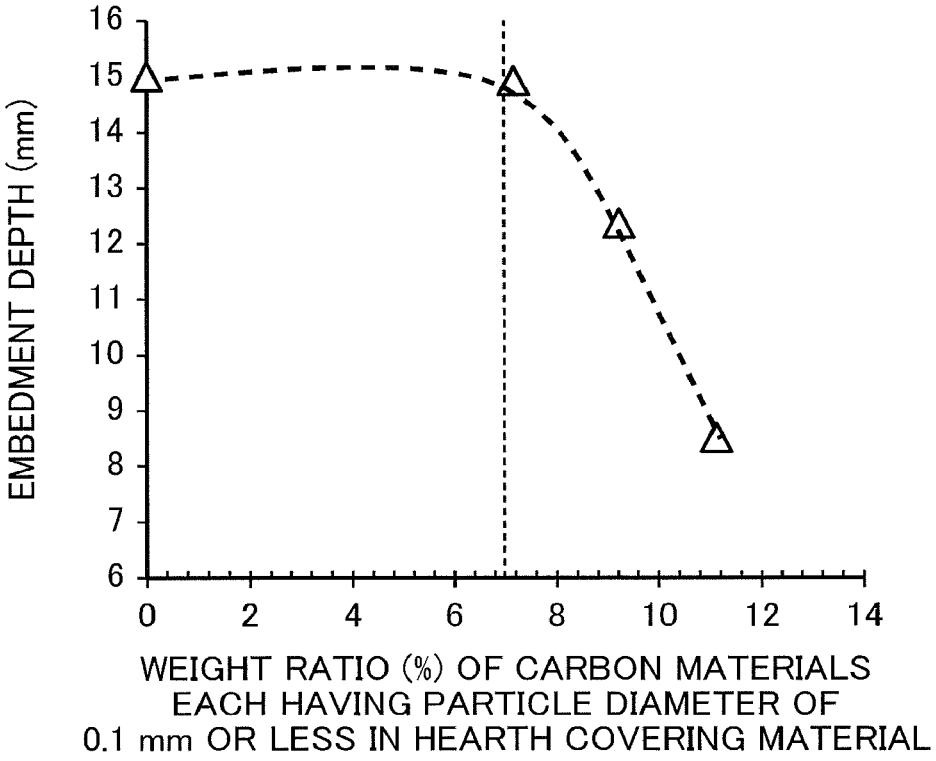
FIG. 7 is a graph showing a relationship between a weight ratio of carbon materials having respective particle diameters each being 0.1 mm or less in a hearth covering material and an embedment depth of test bodies as an experiment result of examining an effect of preventing the reduced-iron raw materials in the hearth covering material from being embedded in the first embodiment.

The present inventors have conducted an experiment in order to verify the effect of preventing embedment of the reduced-iron raw materials 2, thus having obtained a relationship between the weight ratio of carbon materials having respective particle diameters each being 0.1 mm or less in the hearth covering material 18 and the embedment depth of test bodies, such as shown in FIG. 7.

The conditions for the experiment are as follows. The hearth covering material 18 used in the experiment is constituted by carbon materials obtained by sieving the hearth covering material that are turned into coke and has been collected together with the reduced iron and the slag. Specifically, each of the carbon materials has a particle diameter of 5 mm or less (for example, 3.5 mm or less) which is smaller than an average particle diameter of the slag. However, the content ratio (weight ratio) of carbon materials each having a particle diameter of 0.1 mm or less differs sample by sample (0, 7, 9, and 11 wt % in the graph of FIG. 7). Besides, in order to enhance the reproducibility of the experiment, alumina balls are used as the falling test bodies because the reduced-iron raw materials greatly vary in the physical property values due to individual difference and are deteriorated by handling or the like. As each of the alumina balls, used is one having a diameter of 21 mm, in consideration of the dimension and weight of reduced-iron raw materials 2 that are generally used. Although each of the alumina balls has an apparent density which is a little higher than that of the reduced-iron raw materials, this involves no problem because the embedment depth in the present test can be evaluated through relative comparison. The falling height of the test bodies is 0.4 m.

The graph of FIG. 7 shows a result of examining the embedment depth of the test bodies having fallen onto the hearth covering material 18 under the aforementioned experiment conditions. The graph shows that the embedment depth of the test bodies into the hearth covering material 18 in which the content ratio of carbon materials each having a particle diameter of 0.1 mm or less is 7 wt % or more is considerably smaller while the embedment depth of the test bodies into the hearth covering material 18 in the case where the aforementioned content ratio is less than 7 wt % is approximately equal to the embedment depth (about 15 mm) in the case where the aforementioned content ratio is 0 wt %. This experiment teaches that the aforementioned content ratio of 11 wt % allows the embedment depth to be decreased value of about 8 mm.

Figure 8:
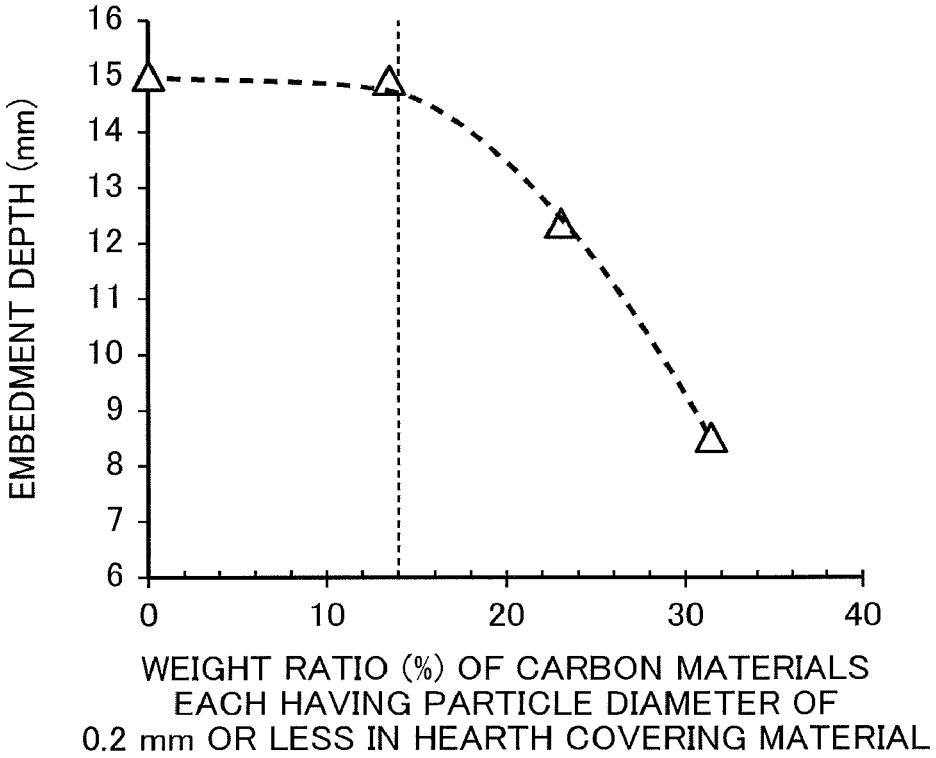
FIG. 8 is a graph showing a relationship between a weight ratio of carbon materials having respective particle diameters each being 0.2 mm or less in the hearth covering material and the embedment depth of test bodies.

FIG. 8 shows a result of examining a relationship between the weight ratio of carbon materials having respective particle diameters each being 0.2 mm or less in the carbon materials constituting the hearth covering material 18 and the embedment depth of test bodies in a manner similar to the experiment of the graph of FIG. 7. This graph shows that the embedment depth is considerably small when at least 14 wt % of the carbon materials constituting the hearth covering material 18 have respective particle diameters each being 0.2 mm or less. Accordingly, the use of a fine-particle hearth covering material constituted by carbon materials each having a particle diameter of 5 mm or less wherein at least 7 mass % thereof have respective particle diameters each being 0.1 mm or less and at least 14 wt % thereof have respective particle diameters each being 0.2 mm or less restrains the reduced-iron raw materials from embedment into the hearth covering material more effectively, thus allowing heat to be input better into the reduced-iron raw materials.

Figure 9:
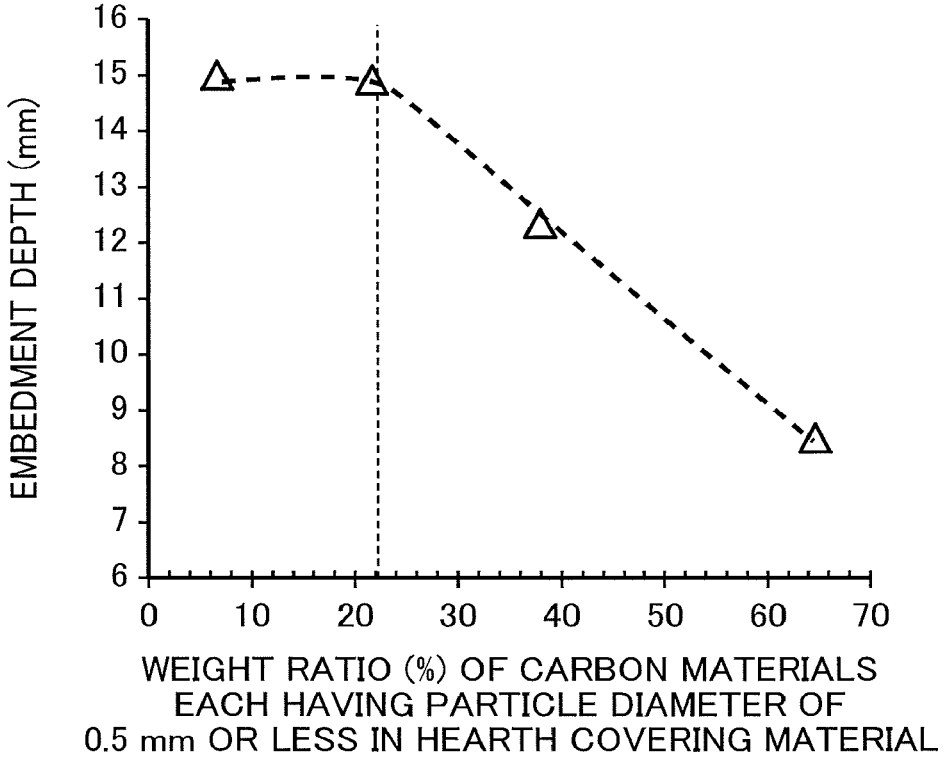
FIG. 9 is a graph showing a relationship between a weight ratio of carbon materials having respective particle diameters each being 0.5 mm or less in the hearth covering material and the embedment depth of test bodies.

FIG. 9 shows a result of examining a relationship between the weight ratio of carbon materials having respective particle diameters each being 0.5 mm or less in the carbon materials constituting the hearth covering material 18 and the embedment depth of test bodies in a manner similar to the experiment of the graph of FIG. 7. This graph shows that the embedment depth is considerably small when at least 22 wt % of the carbon materials constituting the hearth covering material 18 have respective particle diameters each being 0.5 mm or less. Accordingly, the use of a fine-particle hearth covering material constituted by carbon materials each having a particle diameter of 5 mm or less wherein at least 7 mass % thereof have respective particle diameters each being 0.1 mm or less and at least 22 wt % thereof have respective particle diameters each being 0.5 mm or less restrains the reduced-iron raw materials from embedment into the hearth covering material more effectively, thus allowing heat to be input better into the reduced-iron raw materials.

More preferably, at least 7 mass % of the carbon materials constituting the hearth covering material 18 have respective particle diameters each being 0.1 mm or less; at least 14 wt % of the carbon materials have respective particle diameters each being 0.2 mm or less; at least 22 wt % of the carbon materials have respective particle diameters each being 0.5 mm or less. The thus configured hearth covering material 18 suppresses the aforementioned embedment more effectively to enable heat to be input further better into the reduced-iron raw materials.

Figure 10:
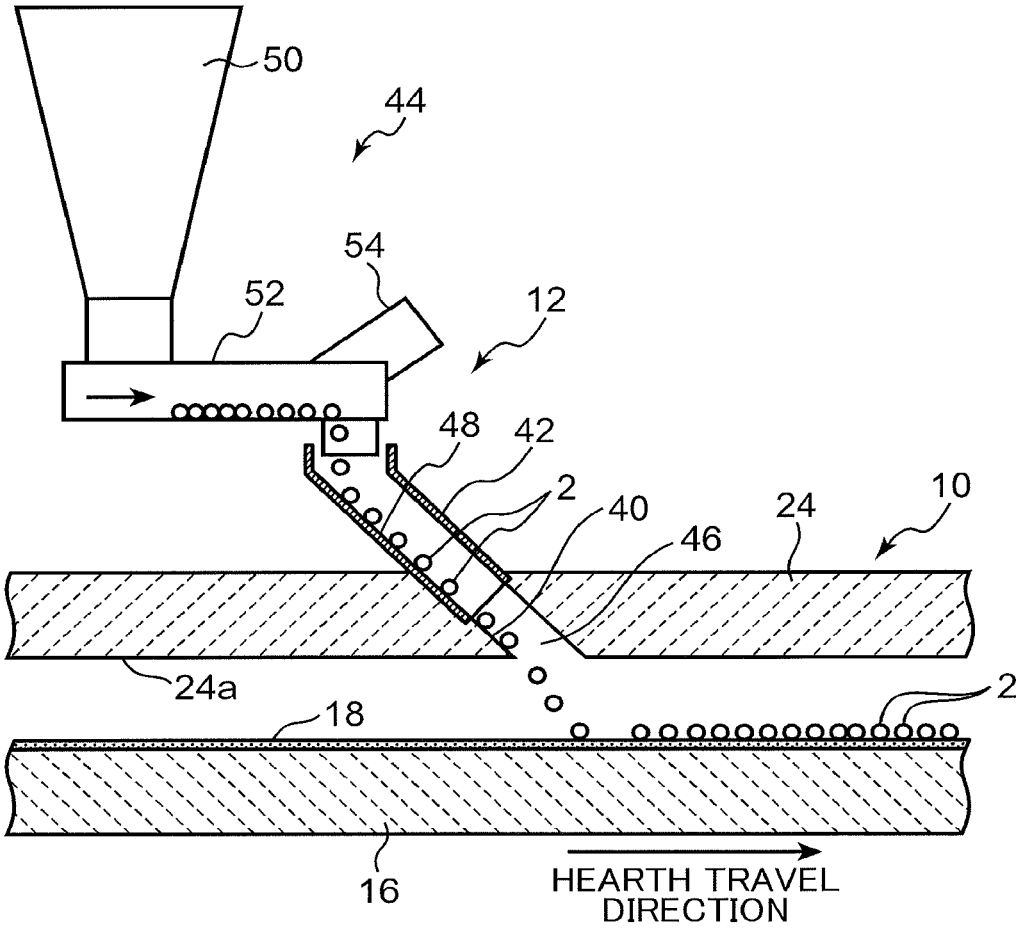
FIG. 10 is a sectional view showing a section of a reduction-melting furnace provided with a raw material charging unit that rolls reduced-iron raw materials on a hearth covering material by letting the reduced-iron raw materials fall obliquely downwards in a reduced iron production apparatus used for a reduced iron production method according to a second embodiment of the present invention, the sectional view taken along a central line in the width direction of the reduction-melting furnace.
Figure 11:
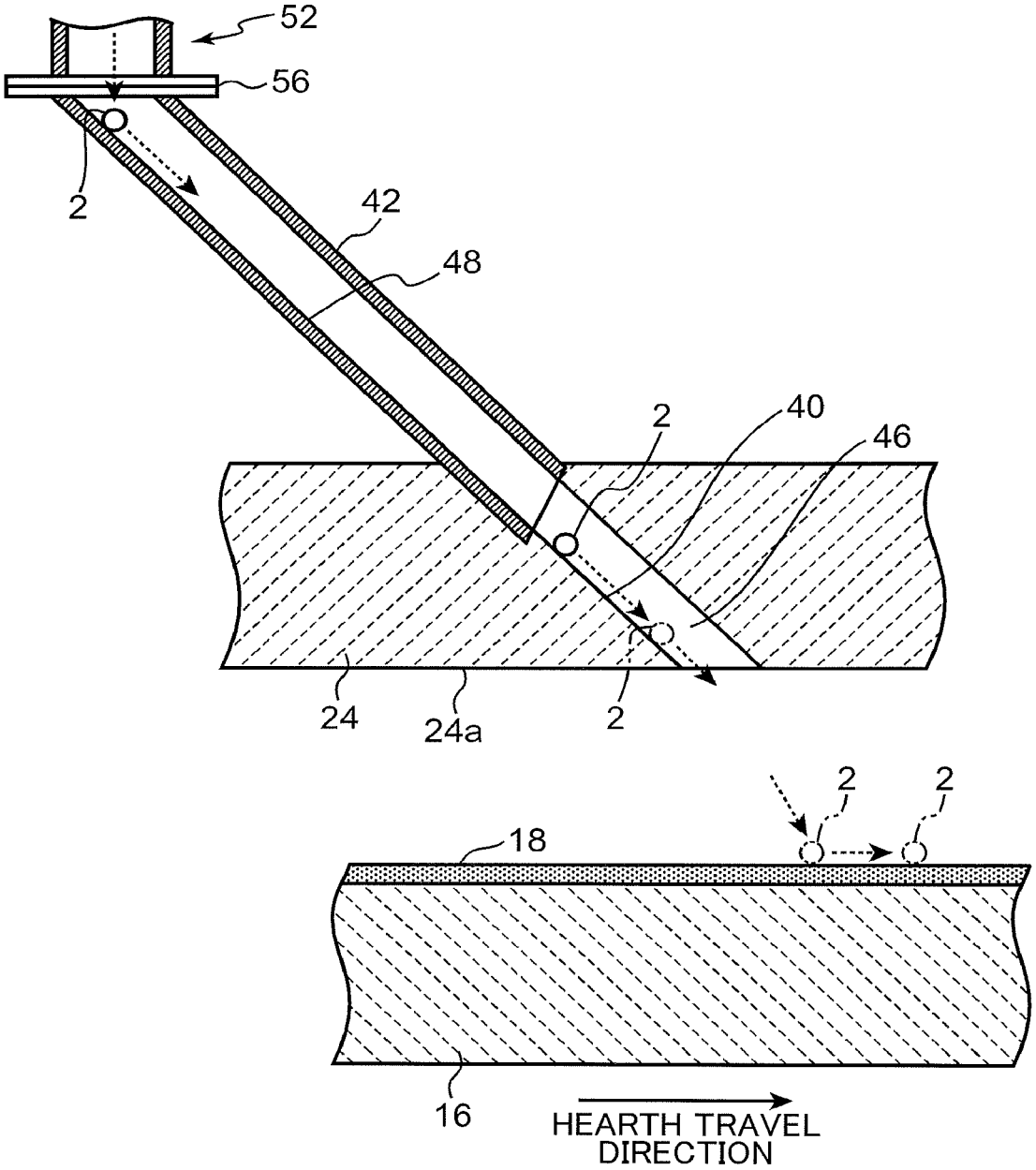
FIG. 11 is a sectional view showing an essential part of the section shown in FIG. 10.

Specific modes for supplying the reduced-iron raw materials according to the present invention are not limited. Although the reduced-iron raw materials 2 according to the first embodiment are supplied onto the hearth covering material 18 through their respective substantially vertical fall onto the hearth covering material 18 through the introduction tube 45 penetrating the ceiling 24 as shown in FIG. 5, supplying modes thereof are not limited to the embodiment. For example, as shown in FIGS. 10 to 11 as a second embodiment, reduced-iron raw materials 2 may be supplied onto the hearth covering material 18 so as to fall obliquely downwards and then roll on the hearth covering material 18. This supplying mode enables the reduced-iron raw materials 2 to be more effectively restrained from embedment into the hearth covering material 18.

In the second embodiment, when the reduced-iron raw materials 2 are spherical, the raw material charging step may include ejecting the reduced-iron raw materials 2 downward from a lower surface of the ceiling 24 located over the hearth 16 and letting the reduced-iron raw materials 2 fall onto the hearth covering material 18 while giving a horizontal velocity, which is in the same direction as a travel direction of the hearth 16 and greater than a moving speed of the hearth 16, to the reduced-iron raw materials 2, to thereby roll the reduced-iron raw materials 2 on the hearth covering material 18 in a direction of the horizontal velocity.

The reduced iron production apparatus used in the second embodiment includes the aforesaid traveling-hearth reduction melting furnace 10, the aforesaid discharging unit 14, and a plurality of raw material charging units 12, as shown in FIGS. 10 and 11, wherein the configuration of the raw material charging units 12 is a little different from that of the raw material charging units 12 according to the first embodiment.

Specifically, each of the raw material charging units 12 shown in FIGS. 10 to 11 includes a slope surface 40 formed internally of the ceiling 24, an extension member 42 to extend the slope surface upward beyond the slope surface 40, and a raw material supplying unit 44.

The slope surface 40 in the second embodiment is a flat surface, inclined downward along the travel direction of the hearth 16. In the second embodiment, the lower end of the slope surface 40 coincides with the lower surface 24*a* of the ceiling 24; however, the lower end may be located above the lower surface 24*a*. In other words, the slope surface 40 may be terminated at a position above the lower surface 24*a*. Each of the reduced-iron raw materials 2 can descend along this slope surface 40 so as to roll on the slope surface 40 (this roll may include sliding) and is thereafter ejected downwards from the lower surface 24*a* of the ceiling 24. Upon the ejection, each of the reduced-iron raw materials 2 is given a horizontal velocity corresponding to the inclination angle of the slope surface 40. In the second embodiment, the ceiling 24 is formed with a through-hole 46 penetrating the ceiling 24 at the aforesaid inclination angle, and the surface located under the through-hole 46 forms the slope surface 40.

This slope surface 40 may be formed by either a surface of the refractory constituting the ceiling 24 or a covering material that covers the surface of the refractory. In the case of using a covering material, the state of descent of each reduced-iron raw material 2 can be adjusted through selection of the covering material. For example, setting the dynamic friction coefficient of the slope surface 40 to the reduced-iron raw materials 2 to be small (for example, to be 0.4 or less) or setting the repulsion coefficient to be small makes it possible to suppress the bound of the reduced-iron raw materials 2 on the slope surface 40 to thereby stabilize the position at which each of the reduced-iron raw materials 2 falls on the hearth covering material 18.

The extension member 42 in the second embodiment is formed of a prismatic tube material, having a lower surface which forms an extended slope surface 48. The extension member 42 is inserted obliquely into the upper part of the through-hole 46, thereby allowing the extended slope surface 48 to be continuous with the slope surface 40. Specifically, there is given a step corresponding to the thickness of the extension member 42 between the upper part of the through-hole 46 and a section located therebelow, to thereby secure the continuity of the two slope surfaces 48, 40. The extension member 42 can be omitted in some cases.

Each of the slope surface 40 and the extended slope surface 48 is not limited to a flat surface. For example, the slope surface 40 and the extended slope surface 48 may be curved surfaces that form a curvilinear shape as viewed from the sides of the reduction-melting furnace 10. In this case, when the slope surfaces have a curved shape such that the tangential direction of the slope surfaces approaches the horizontal direction along with the slope surfaces coming downwards, the moving direction of the reduced-iron raw materials 2 that are ejected from the lower surface 24*a* of the ceiling 24 can be directed at an angle closer to the horizontal direction than a general repose angle. Besides, the shape of the slope surfaces 40, 48 as viewed in the direction along the inclination thereof may be either a horizontal straight line or a straight or curved line with concavities and convexities. For example, the shape may include a plurality of grooves that are laterally arranged, each of the grooves having a width enough to allow the reduced-iron raw materials 2 to pass. In any case, it is preferable that the extended slope surface 48 has a shape capable of being continuous with the shape of the slope surface 40.

The inclination angle of the slope surfaces 48, 40 can be arbitrarily set. However, when the slope surfaces 48, 40 are flat surfaces, the inclination angle of the slope surfaces 48, 40 is preferably an angle equal to or more than the repose angle, that is, an angle equal to or more than the angle which surely prevents the reduced-iron raw materials 2 from staying on the slope surfaces 48, 40. Typically, the inclination angle is preferably 36° or more. Besides, the inclination angle is preferably an angle that allows the reduced-iron raw materials 2 to surely receive a reaction force from the slope surfaces 48, 40, that is, an angle that allows the reduced-iron raw materials 2 to surely keep contact with the slope surfaces 48, 40. Typically, the inclination angle is preferably 60° or less. Even if the inclination angle is less than 36°, the reduced-iron raw materials 2 can be surely ejected from the lower surface 24*a* of the ceiling 24 by addition of means for preventing the reduced-iron raw materials 2 from staying on the slope surfaces, for example, means for assisting the reduced-iron raw materials 2 to descent along the slope surfaces.

Figure 5:
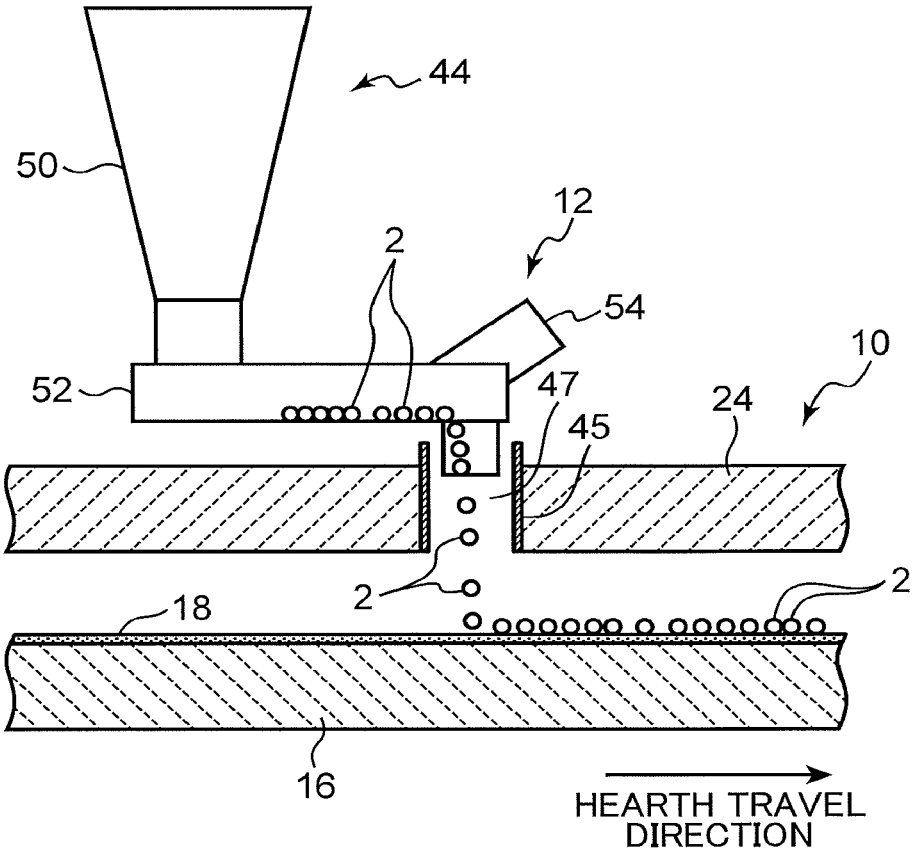
FIG. 5 is a sectional view showing the raw material charging unit and a section of the reduction-melting furnace in a neighborhood of the raw material charging unit, the sectional view taken along a central line in the width direction of the reduction-melting furnace.

The raw material supplying unit 44 has a configuration similar to that of the raw material supplying unit 44 shown in FIG. 5, including the supply hopper 50, the feeder tray 52, and the vibration applying device 54. The feeder tray 52 shown in FIGS. 10 to 11 is connected to the extension member 42. For example, the feeder tray 52 is connected to the extension member 42 via a flange 56 or a water seal, as shown in FIG. 11. In the case of omission of the extension member 42, the raw material supplying unit 44 may be connected directly to the ceiling 24.

Next will be described a reduced iron production method according to the second embodiment of the present invention with reference to FIGS. 10 to 11.

First, there are prepared numerous reduced-iron raw materials 2, that is, a plurality of spherical agglomerates each containing a carbonaceous reducing agent and an iron oxide. The term "spherical" only requires the reduced-iron raw materials 2 to be spherical enough to allow the reduced-iron raw materials 2 to roll after landing on the hearth covering material 18 in the reduction-melting furnace 10, as described below; therefore, the reduced-iron raw material 2 is not required to be a complete sphere. Generally, it is preferable that any cross section passing through the center of the reduced-iron raw material 2 has a circularity of 0.7 or more. The reduced-iron raw material 2 thus having a section with high circularity is able to roll smoothly even on the slope surfaces 48, 40, which stabilizes the position at which the reduced-iron raw material 2 falls onto the hearth covering material 18.

The thus prepared numerous reduced-iron raw materials 2 are put into the supply hopper 50 and successively supplied through the feeder tray 52 to the extension member 42 (or slope surface 40 of the ceiling 24 in the case where the extension member 42 is omitted). The supplied reduced-iron raw material 2 descends along the slope surfaces 48, 40 while rolling on the slope surfaces 48, 40 that are inclined toward the travel direction of the hearth 16, and is thereafter released from the constraint by the slope surfaces 48, 40, that is, ejected, after the time point at which the reduced-iron raw materials 2 reach the lower surface 24*a* of the ceiling 24, and land on the fine-particle hearth covering material 18 (that is, the fine-particle hearth covering material 18 which includes carbon materials each having a particle diameter of 5 mm or less wherein at least 7 mass % of the carbon materials have respective particle diameters each being 0.1 mm or less).

Figure 12:
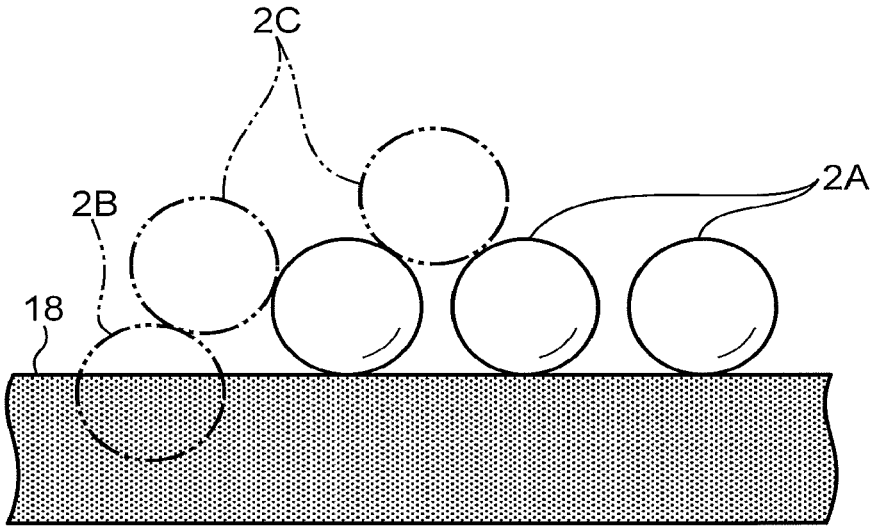
FIG. 12 is a sectional view showing an example of a state of the reduced-iron raw material having been charged into the reduction-melting furnace of FIG. 10.

Upon the ejection, the reduced-iron raw material 2 is given a horizontal velocity corresponding to the inclination angle of the slope surfaces 48, 40 in addition to the downward velocity due to gravity. When the given horizontal velocity is higher to some extent than the traveling speed of the hearth 16, the reduced-iron raw materials 2 can roll in the travel direction of the hearth 16 after landing on the hearth covering material 18, that is, the reduced-iron raw materials 2 can escape from the position of landing, as shown in FIGS. 10 to 11, in the travel direction of the hearth 16. This roll, thus, makes it possible to prevent the follow-on reduced-iron raw material 2 from being stacked onto the precedent reduced-iron raw material 2 (for example, a state shown in FIG. 12 in which the follow-on reduced-iron raw material 2C rides on the precedent reduced-iron raw materials 2A, 2B) or prevent the precedent reduced-iron raw material 2 from embedment into the hearth covering material 18 due to fall of the follow-on reduced-iron raw material 2 (a state of the reduced-iron raw material 2B shown in FIG. 12).

In other words, the magnitude of the horizontal velocity to be given to the reduced-iron raw materials 2 only has to be set enough to ensure the roll of the reduced-iron raw materials 2 after the reduced-iron raw materials 2 land on the hearth covering material 18. Specifically, the magnitude of the horizontal velocity may be set in accordance with various conditions such as the size and specific gravity of the reduced-iron raw materials 2, the vertical speed of ejecting from the lower surface 24*a* of the ceiling 24, the distance of fall to the hearth covering material 18, and the material of the hearth covering material 18.

The roll of the reduced-iron raw materials 2 on the hearth covering material 18 as described above suppresses, more effectively, stacking of the follow-on reduced-iron raw material 2 onto the precedent reduced-iron raw material 2 or embedment of the reduced-iron raw materials 2 into the hearth covering material 18. Specifically, the roll of the reduced-iron raw materials 2 that are given a horizontal velocity as described above, in the hearth travel direction, enables the precedent reduced-iron raw material 2A to get forward away through its roll by the time at which the follow-on reduced-iron raw material 2C shown in FIG. 12 falls onto the hearth covering material 18, even when the hearth travel speed is somewhat slow. This restrains the precedent reduced-iron raw material 2A from embedment due to the fall of the follow-on reduced-iron raw material 2C onto the precedent reduced-iron raw material 2A or due to scattering of the hearth covering material 18 caused by the fall of the follow-on reduced-iron raw material 2C into a neighborhood of the precedent reduced-iron raw material 2A. Although the follow-on reduced-iron raw material 2C approaches the precedent reduced-iron raw material 2A through its roll and the roll may cause collision, the collision would be weak and the direction thereof would be horizontal; furthermore, the roll does not involve considerable scattering of the hearth covering material 18. Accordingly, embedment of the precedent reduced-iron raw material 2A due to the collision or scattering of the hearth covering material 18 is suppressed.

Charging of the reduced-iron raw materials 2 with such an effective suppression of the stacking of the reduced-iron raw materials 2 onto each other and the embedment of the reduced-iron raw materials 2 enables heat to be input better into the reduced-iron raw materials 2. This heat input enables the reduced-iron raw materials 2 to be subject to good heating treatments (temperature-raising, reduction, and melting treatments) in the respective zones Z1 to Z3 within a short period of time, and the reduced iron cooled thereafter in the cooling zone Z4 can be discharged by the discharging unit 14 as high quality metal iron.

As described above, the method according to the second embodiment includes respective rolls of the reduced-iron raw materials 2 on the hearth covering material 18, which enables high quality metal iron to be produced in a short period of time. To achieve the roll, it is preferable to give the reduced-iron raw materials 2 a horizontal velocity having a magnitude enough to allow the reduced-iron raw materials 2 to be incident onto the hearth covering material 18 at an angle of 60° or less. The incidence angle of 60° or less makes the magnitude of the horizontal velocity be ½ or more of the speed of incidence, which allows the reduced-iron raw materials 2 to roll surely in the hearth travel direction against sinking of the reduced-iron raw materials 2 into the hearth covering material 18 due to the fall thereof onto the hearth covering material 18. Hence, it is preferable that the inclination angle of the slope surface 40 or the slope surfaces 48, 40 is set from such a viewpoint.

Means for giving a horizontal velocity as described above to the reduced-iron raw materials is not limited to respective rolls of the reduced-iron raw materials on the slope surfaces. For example, it is also possible to give the horizontal velocity to the reduced-iron raw materials by spraying a high-pressure gas horizontally onto the reduced-iron raw material having been vertically ejected from the lower surface of the ceiling. However, the above respective rolls of the reduced-iron raw materials on the slope surfaces provided in the ceiling as described above makes it possible to give a horizontal velocity to the reduced-iron raw materials having been ejected from the lower surface of the ceiling without additional complex or large-scale equipment that has to have heat resistance in a high-temperature region below the ceiling; this advantageously suppresses the stacking of the reduced-iron raw materials onto each other and embedment of the reduced-iron raw materials into the hearth covering material without involving decrease in the reliability of the charging equipment or considerable rise in the costs and without giving considerable adverse effects on the flow of the gas in the furnace below the lower surface of the ceiling.

As described above, provided is a method for producing reduced iron by charging a plurality of reduced-iron raw materials each containing a carbonaceous reducing agent and iron oxide into a traveling-hearth reduction melting furnace and treating the reduced-iron raw materials, the method enabling heat to be input well into each of the reduced-iron raw materials supplied through their respective falls onto a powdery hearth covering material to thereby enhance the efficiency of treatment thereof. Provided is a method for producing reduced iron, the method including: a raw material charging step of successively charging a plurality of reduced-iron raw materials each containing a carbonaceous reducing agent and an iron oxide into a reduction-melting furnace having a hearth that travels in a specific direction and a hearth covering material formed of powder laid on the hearth and letting the reduced-iron raw materials fall onto the hearth covering material to set the reduced-iron raw materials on the hearth covering material; and a reduced iron discharging step of successively reducing each of the reduced-iron raw materials on the hearth covering material along with travel of the hearth to thereby produce reduced iron and discharging the reduced iron produced to outside of the reduction-melting furnace. The hearth covering material is constituted by carbon materials each having a particle diameter of 5 mm or less. At least 7 mass % of the carbon materials have respective particle diameters each being 0.1 mm or less. This method makes it possible to restrain the reduced-iron raw materials from embedment by use of the hearth covering material having a smaller particle diameter as compared with that of a conventional hearth covering material.

Preferably, the reduced-iron raw materials are spherical, and the raw material charging step includes ejecting the reduced-iron raw materials downward from a lower surface of a ceiling located above the hearth and letting the reduced-iron raw materials fall onto the hearth covering material while giving a horizontal velocity, which is in the same direction as a travel direction of the hearth and greater than a moving speed of the hearth, to the reduced-iron raw materials to thereby roll the reduced-iron raw materials on the hearth covering material in a direction of the horizontal velocity.

The "spherical" reduced-iron raw material as referred to herein is not limited to a complete sphere. The aforesaid "spherical" reduced-iron raw materials encompass also a reduced-iron raw material that is not exactly a sphere but close to a sphere to an extent enough to allow the reduced-iron raw material to roll on the powdery hearth covering material, for example, a reduced-iron raw material in which the circularity of any section passing through the center of the reduced-iron raw material is enough high to satisfy the conditions for rolling on the powdery hearth covering material.

The rolling of the reduced-iron raw materials on the hearth covering material suppresses more effectively stacking of a follow-on reduced-iron raw material onto a precedent reduced-iron raw material and embedment of the reduced-iron raw materials into the hearth covering material, thereby enabling heat to be input better into each of the reduced-iron raw materials. Specifically, each of the reduced-iron raw materials that are successively supplied onto the hearth covering material rolls away from the point of fall thereof in the hearth travel direction, which makes it possible to effectively prevent a follow-on reduced-iron raw material from being stacked onto the reduced-iron raw material. Besides, the roll makes it possible to suppress not only embedment of the reduced-iron raw material at the point of fall thereof but also embedment caused by fall of the reduced-iron raw material falls erroneously onto a precedent reduced-iron raw material to press the precedent reduced-iron raw material into the hearth covering material and embedment of a precedent reduced-iron raw material due to the powdery hearth covering material that has been scattered by the fall of a follow-on reduced-iron raw material to cover the precedent reduced-iron raw material.

The invention claimed is:

1. A method for producing reduced iron, the method comprising:

successively charging a plurality of reduced-iron raw materials each containing a carbonaceous reducing agent and an iron oxide into a reduction-melting furnace having a hearth that travels in a horizontal direction and a hearth covering material formed of powder laid on the hearth and letting the reduced-iron raw materials fall onto the hearth covering material to set the reduced-iron raw materials on the hearth covering material; and successively reducing each of the reduced-iron raw materials on the hearth covering material along with travel of the hearth to thereby produce reduced iron and discharging the reduced iron produced to outside of the reduction-melting furnace, wherein the hearth covering material is constituted by carbon materials each having a particle diameter of 5 mm or less, wherein at least 7 mass % of the carbon materials have respective particle diameters each being 0.1 mm or less, wherein the reduced-iron raw materials are spherical, wherein the successively charging comprises ejecting the reduced-iron raw materials downward from a lower surface of a ceiling located above the hearth and letting the reduced-iron raw materials fall onto the hearth covering material while giving a horizontal velocity, which is in the same direction as a travel direction of the hearth and greater than a moving speed of the hearth, to the reduced-iron raw materials to thereby roll the reduced-iron raw materials on the hearth covering material in a direction of the horizontal velocity, wherein the successively charging comprises letting the reduced-iron raw material fall on the heath along a slope surface formed internally of the ceiling, and wherein the slope surface has an inclination angle of from 36° to 60° with respect to ceiling.

2. The method of claim 1, further comprising, prior to the successively charging:

preparing the hearth covering material by adding fine-particle carbon materials each having particle diameters of 0.1 mm or less to carbon materials each having a particle diameter of 5 mm or less.

3. The method of claim 1, wherein the carbon materials are anthracite or coke.

4. The method of claim 1, wherein the reduced-iron raw materials fall onto the hearth covering material at a horizontal velocity corresponding to an inclination angle of a slope surface formed internally of the ceiling in addition to a downward velocity due to gravity.

5. The method of claim 1, wherein the slope surface is a curved surface as viewed from sides of the reduction-melting furnace.

* * * * *